US010201823B2

(12) United States Patent
Gliksman

(10) Patent No.: US 10,201,823 B2
(45) Date of Patent: Feb. 12, 2019

(54) PAINT SPRAYER ATTACHMENT

(71) Applicant: Stephen Gliksman, Lake Forest, CA (US)

(72) Inventor: Stephen Gliksman, Lake Forest, CA (US)

( * ) Notice: Subject to any disclaimer, the term of this patent is extended or adjusted under 35 U.S.C. 154(b) by 0 days.

(21) Appl. No.: 15/847,722

(22) Filed: Dec. 19, 2017

(65) Prior Publication Data

US 2018/0169672 A1 Jun. 21, 2018

Related U.S. Application Data

(60) Provisional application No. 62/436,140, filed on Dec. 19, 2016.

(51) Int. Cl.

| | |
|---|---|
| ***B05B 12/22*** | (2018.01) |
| ***B05B 12/34*** | (2018.01) |
| ***B05B 13/02*** | (2006.01) |
| ***B05B 1/28*** | (2006.01) |
| ***B05B 12/36*** | (2018.01) |
| ***B05B 7/24*** | (2006.01) |
| ***B05C 17/02*** | (2006.01) |
| ***B05C 15/00*** | (2006.01) |
| ***B05C 21/00*** | (2006.01) |
| *B05B 11/00* | (2006.01) |
| *B05B 15/68* | (2018.01) |

(52) U.S. Cl.

CPC ..... *B05B 12/34* (2018.02); *B05B 1/28* (2013.01); *B05B 7/2408* (2013.01); *B05B 12/22* (2018.02); *B05B 12/36* (2018.02); *B05B 13/0278* (2013.01); *B05C 15/00* (2013.01); *B05C 17/023* (2013.01); *B05C 21/005* (2013.01); *B05B 11/0013* (2013.01); *B05B 15/68* (2018.02)

(58) Field of Classification Search

CPC ..... B05B 13/0278; B05B 15/0425; B05B 15/0437; B05B 15/68; B05B 12/22; B05B 12/34; B05C 17/023; B05C 15/00; B05C 21/005

See application file for complete search history.

(56) References Cited

U.S. PATENT DOCUMENTS 3,015,837 A * 1/1962 Teall ..... B05B 9/01 118/118
3,315,639 A * 4/1967 Close ..... B05B 16/40 118/642
3,709,194 A * 1/1973 Hammelmann ..... B63B 59/10 118/305

(Continued)

*Primary Examiner* — Karl Kurple

(57) ABSTRACT

A paint sprayer attachment that prevents over spray mist from dispersing into the open air, thus allowing a user to operate a paint sprayer without wearing a mask, includes a spray hood, a first edger, a second edger, a first roller assembly, and a second roller assembly. The spray hood is a thin-walled, dome-like structure to which the first edger, the second edger, the first roller assembly, and the second roller assembly are attached. The first edger and the second edger enclose the sides of the spray hood, and provide non-abrasive surfaces for applying paint to a desired surface. A first paint roller from the first roller assembly and a second paint roller from the second roller assembly are positioned at opposite ends of the spray hood, wherein the first paint roller and the second paint roller enclose the front and back of the spray hood.

16 Claims, 12 Drawing Sheets

(56) References Cited

U.S. PATENT DOCUMENTS

| | | | | |
|---|---|---|---|---|
| 5,529,815 | A * | 6/1996 | Lemelson | C23C 16/04 118/720 |
| 5,654,041 | A * | 8/1997 | Appich | B05C 9/02 118/401 |
| 6,245,392 | B1 * | 6/2001 | Hillenbrand | B05C 9/14 427/498 |
| 6,370,728 | B1 * | 4/2002 | Burns | A47L 11/201 15/320 |
| 6,439,712 | B1 * | 8/2002 | Mizutani | B41J 2/01 219/216 |
| 6,468,350 | B1 * | 10/2002 | Hillenbrand | B05C 9/14 118/207 |
| 7,029,533 | B1 * | 4/2006 | Hedding | B05B 16/40 118/326 |
| 7,837,130 | B1 * | 11/2010 | Lowery | B01D 46/10 239/120 |
| 9,950,334 | B1 * | 4/2018 | Massey | B05B 1/28 |
| 2011/0259264 | A1 * | 10/2011 | Cervera | B05C 17/023 118/255 |
| 2013/0145572 | A1 * | 6/2013 | Schregardus | A47L 11/4036 15/319 |
| 2013/0171684 | A1 * | 7/2013 | Calfee | B05B 1/28 435/31 |

* cited by examiner

PAINT SPRAYER ATTACHMENT

The current application claims a priority to the U.S. Provisional Patent application Ser. No. 62/436,140 filed on Dec. 19, 2016.

FIELD OF THE INVENTION

The present invention relates generally to paint sprayers. More specifically, the present invention is a paint sprayer attachment that enables the user to spray paint surfaces without the need of a mask and prevents over spraying, dripping, or splattering.

BACKGROUND OF THE INVENTION

Painting anything can be a messy and time-consuming task to accomplish. The act of painting often requires a great amount of preparation to ensure paint does not get on anything that is not supposed to be painted. Furthermore, the act of painting itself is a time intensive process, especially when painting large surfaces. In an effort to speed up paint times, spray painters are often used to quickly apply a coat of paint to a large surface area. However, the act of spray painting creates a large amount of over spray mist that is dispersed into the surrounding environment of the painter. Many spray paints contain harmful chemicals that can lead to disease and harm to the user, if the over spray mist is inhaled by the user. As such, a face mask is often worn when spray painting, to avoid the inhalation of harmful chemicals. While these masks can filter out harmful particles and prevent the user from inhaling dangerous chemicals, such masks can be uncomfortable to wear; especially when wearing such masks for extended periods of time or in hot weather.

Therefore, it is an objective of the present invention to provide a paint sprayer attachment that enables a user to spray paint surfaces without the need of a mask. It is another objective of the present invention to provide a paint sprayer attachment that prevents over spraying, dripping, or splattering while spray painting. The present invention includes a spray hood that fits two paint rollers (a first paint roller in the front and a second paint roller in the back) and has an open space in the middle. A spray unit is attached to the top of the spray hood, wherein a spray tip of the spray unit is positioned in between the first paint roller and the second paint roller, so as to direct the spray fan into the open space of the spray hood and onto the surface to be painted, without touching the rollers. As the paint is sprayed on the surface, the user can roll up, down, and/or sideways without getting any over spray, paint drips, or splatters anywhere outside the unit as the paint rollers and the spray hood completely seal the paint inside. This prevents spray dust from getting into the lungs, eyes, ears, and skin of the user, as the unit prevents any spray dust from escaping. Furthermore, this makes painting much faster as it saves hours of masking.

DETAIL DESCRIPTIONS OF THE INVENTION

Figure 1:
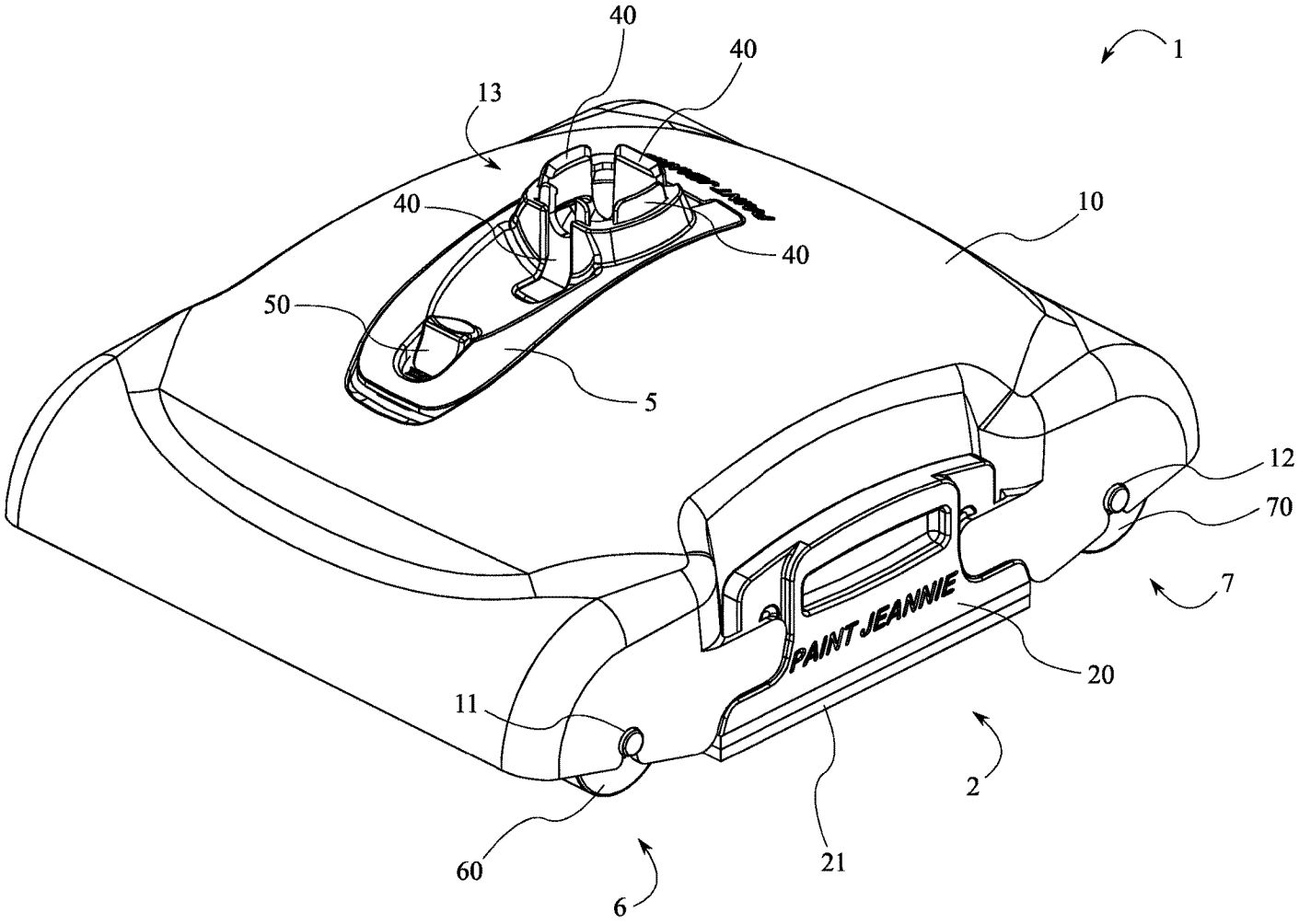
FIG. 1 is a front right perspective view of the present invention.

All illustrations of the drawings are for the purpose of describing selected versions of the present invention and are not intended to limit the scope of the present invention.

The present invention is a paint sprayer attachment that prevents over spray mist from dispersing into the open air, thus allowing a user to operate a paint sprayer without wearing a mask. The present invention forms an enclosure around a spray nozzle that is pressed against a painting surface in order to prevent the over spray mist from escaping into the open air. Furthermore, the present invention includes paint rollers to spread the paint and navigate the present invention across the painting surface.

The present invention comprises a spray hood 1, a first edger 2, a second edger 3, a spray nozzle retainer 5, a first roller assembly 6, and a second roller assembly 7. The spray hood 1 is the main body of the present invention, providing the enclosure to contain the over spray mist, along with mounting points for the spray nozzle, the spray nozzle retainer 5, the first edger 2, the second edger 3, the first roller assembly 6, and the second roller assembly 7. Meanwhile, the spray nozzle retainer 5 holds the spray nozzle in place, while the first edger 2 and the second edger 3 provide height adjustable side walls for the spray hood 1. The first roller assembly 6 and the second roller assembly 7 provide a means for spreading the paint and navigating the spray hood 1 about the painting surface.

Figure 2:
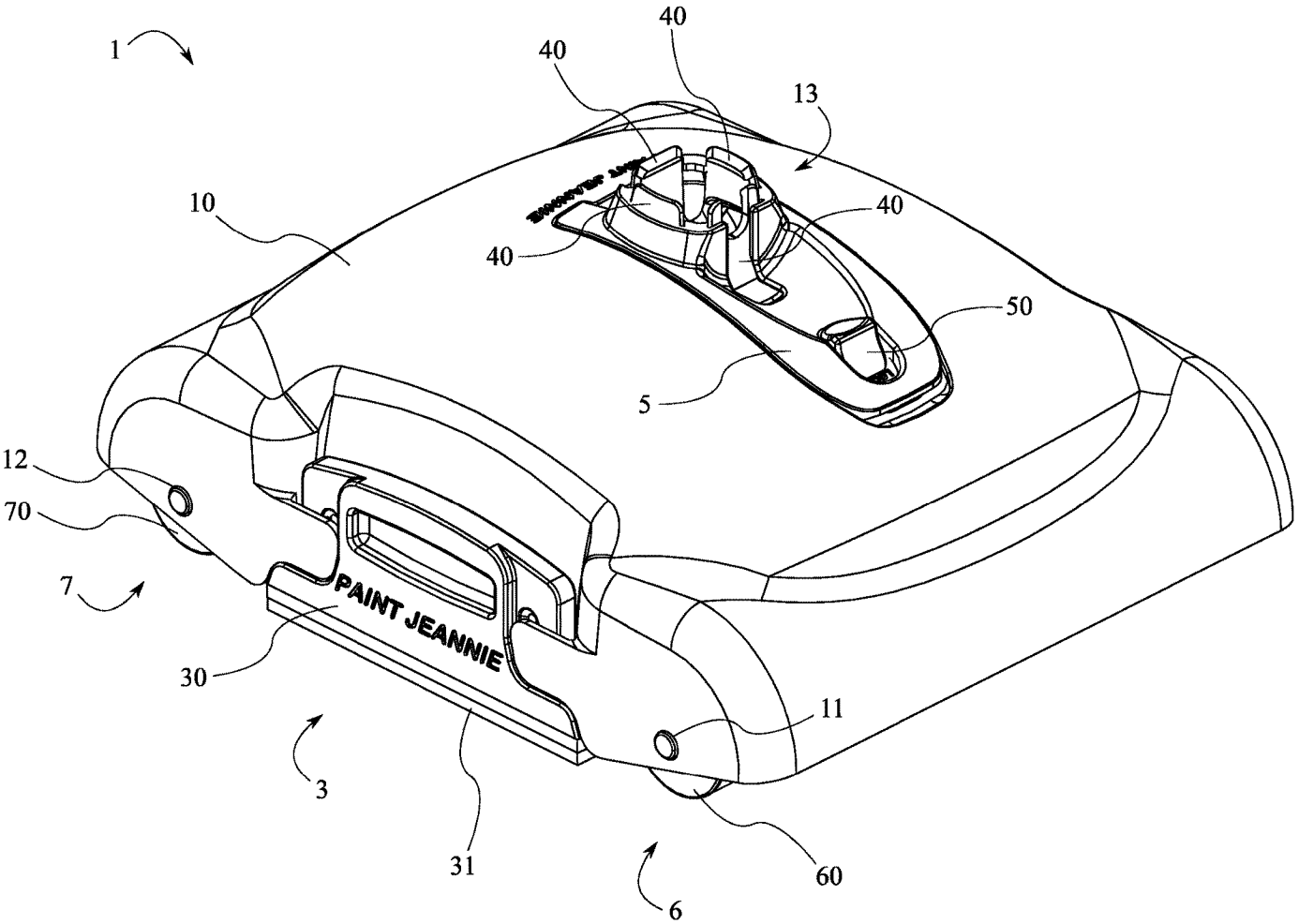
FIG. 2 is a front left perspective view of the present invention.

In reference to FIG. 1-2, the spray hood 1 comprises a concave shell 10, a first pair of roller retention slots 11, a second pair of roller retention slots 12, and a spray nozzle mount 13. The concave shell 10 is a thin walled, dome-like structure that encapsulates the spray zone of the paint sprayer, preventing the over spray mist from escaping into the air. The concave shell 10 has an open bottom, allowing the paint spray to be directed onto the painting surface, and a nozzle aperture 19 formed in the top that allows a spray tip of the paint sprayer to be directed into the interior of the concave shell 10. The spray nozzle mount 13 is maximally integrated into the concave shell 10 about the nozzle aperture 19, wherein the spray nozzle mount 13 secures the spray nozzle to the top of the concave shell 10.

In further reference to FIG. 1-2, the first pair of roller retention slots 11 and the second pair of roller retention slots 12 are laterally integrated into the concave shell 10, and provide mounting points for the first roller assembly 6 and the second roller assembly 7 respectively. The first pair of roller retention slots 11 and the second pair of roller retention slots 12 are distally positioned from the spray nozzle mount 13, such that the first roller assembly 6 and the second roller assembly 7 are mounted towards the base of the concave shell 10. The first pair of roller retention slots 11 and the second pair of roller retention slots 12 are positioned opposite each other along the concave shell 10; the first pair of roller retention slots 11 being positioned towards the front of the concave shell 10 and the second pair of roller retention slots 12 being positioned towards the rear of the concave shell 10.

Each of the first pair of roller retention slots 11 is positioned opposite one another across the concave shell 10. In the preferred embodiment of the present invention, the first pair of roller retentions slots comprises a first roller slot, a second roller slot, and a first snap guide. Each of the first roller slot and the second roller slot is a circular opening formed through the concave shell 10, while the first snap guide is an opening below the second roller slot that is tapered towards the second roller slot. The first roller slot and the second roller slot are concentric with one another, such that first roller assembly 6 may rotate about the common central axis of the first roller slot and the second roller slot. To attach the first roller assembly 6 to the concave shell 10, one end of the first roller assembly 6 is first positioned into the first roller slot. The opposing end of the first roller assembly 6 is then directed upward, through the first snap guide, and snapped into the second roller slot. The first roller assembly 6 is then able to freely rotate within the first pair of roller retention slots 11.

Similar to the first pair of roller retention slots 11, each of the second pair of roller retention slots 12 is positioned opposite one another across the concave shell 10. In the preferred embodiment of the present invention, the second pair of roller retentions slots comprises a third roller slot, a fourth roller slot, and a second snap guide. Each of the third roller slot and the fourth roller slot is a circular opening formed through the concave shell 10, while the second snap guide is an opening below the fourth roller slot that is tapered towards the fourth roller slot. The third roller slot and the fourth roller slot are concentric with one another, such that second roller assembly 7 may rotate about the common central axis of the third roller slot and the fourth roller slot. To attach the second roller assembly 7 to the concave shell 10, one end of the second roller assembly 7 is first positioned into the third roller slot. The opposing end of the second roller assembly 7 is then directed upward, through the second snap guide, and snapped into the fourth roller slot. The second roller assembly 7 is then able to freely rotate within the first pair of roller retention slots 11.

Figure 3:
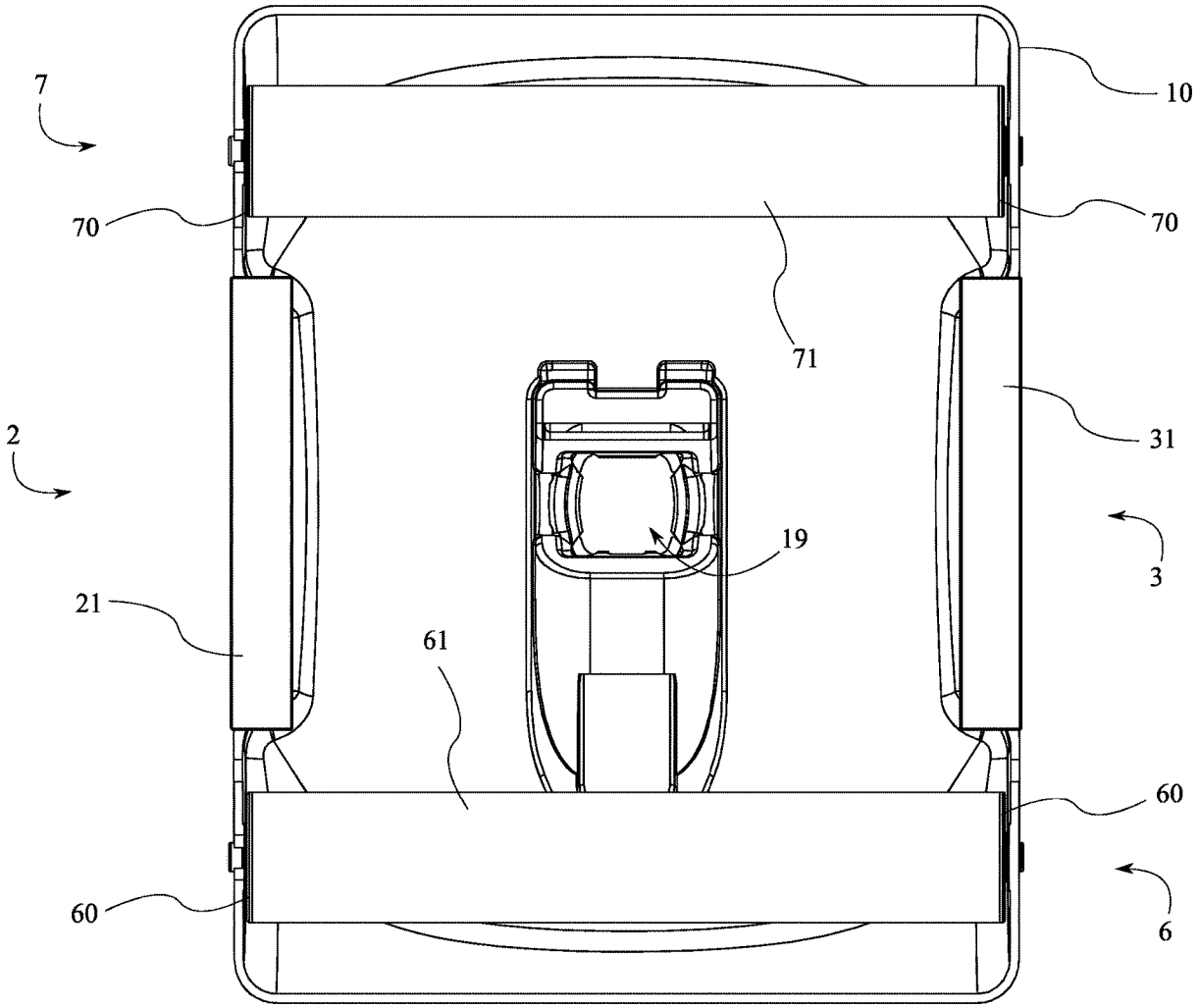
FIG. 3 is bottom plan view of the present invention.
Figure 4:
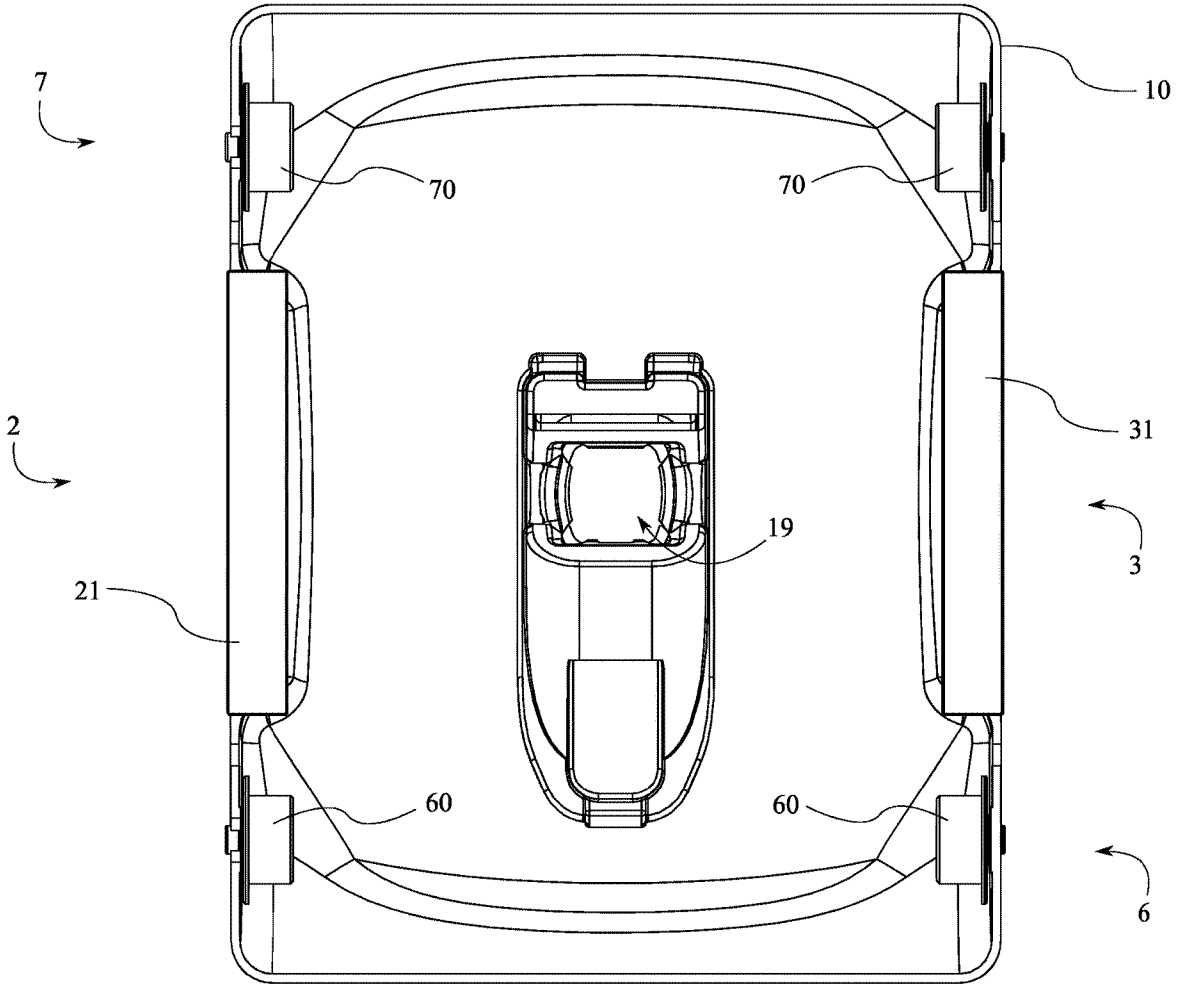
FIG. 4 is a bottom plan view of the present invention, wherein the first paint roller and the second paint roller have been detached from the first pair of roller mounts and the second pair of roller mounts respectively.

In reference to FIG. 3-4, the first roller assembly 6 comprises a first pair of roller mounts 60 and a first paint roller 61. Each of the first pair of roller mounts 60 interfaces with the concave shell 10 and supports the first paint roller 61 within the interior of the concave shell 10. More specifically, each of the first pair of roller mounts 60 is terminally attached to the first paint roller 61 and mounted into a corresponding retention slot from the first pair of roller retention slots 11. In the preferred embodiment of the present invention, the first pair of roller mounts 60 comprises a first mount and a second mount; each of the first mount and the second mount comprising a shell interfacing protrusion and a roller interfacing protrusion. The shell interfacing protrusion and the roller interfacing protrusion are positioned opposite each other, wherein the shell interfacing protrusion is positioned into the corresponding retention slot and the roller interfacing protrusion is positioned into the first paint roller 61.

In further reference to FIG. 3-4, similar to the first roller assembly 6, the second roller assembly 7 comprises a second pair of roller mounts 70 and a second paint roller 71. Each of the second pair of roller mounts 70 interfaces with the concave shell 10 and supports the second paint roller 71 within the interior of the concave shell 10. More specifically, each of the second pair of roller mounts 70 is terminally attached to the second paint roller 71 and mounted into a corresponding retention slot from the second pair of roller retention slots 12. In the preferred embodiment of the present invention, the second pair of roller mounts 70 comprises a third mount and a fourth mount; each of the third mount and the fourth mount comprising a shell interfacing protrusion and a roller interfacing protrusion. The shell interfacing protrusion and the roller interfacing protrusion are positioned opposite each other for each of the third mount and the fourth mount, wherein the shell interfacing protrusion is positioned into the corresponding retention slot of the second pair of roller retention slots 12 and the roller interfacing protrusion is positioned into the second paint roller 71.

In reference to FIG. 1-2, the first edger 2 and the second edger 3 enclose the bottom of each side of the concave shell 10, and provide brushing surfaces along the bottom edge of the concave shell 10. As such, the first edger 2 and the second edger 3 are laterally mounted to the concave shell 10, wherein the first edger 2 and the second edger 3 are positioned opposite each other across the concave shell 10. Furthermore, both the first edger 2 and the second edger 3 are positioned in between the first pair of roller retention slots 11 and the second pair of roller retention slots 12. The first edger 2 and the second edger 3 are removably attached to the concave shell 10, such that the first edger 2 and the second edger 3 can be removed for maintenance or replaced with new edgers.

In further reference to FIG. 1-2, the first edger 2 comprises a first edger body 20 and a first surface interface 21. The first edger body 20 provides the main structure of the first edger 2, and is the portion of the first edger 2 that is mounted to the concave shell 10. Meanwhile, the first surface interface 21 is adjacently connected to the first edger body 20, wherein the first surface interface 21 is positioned along the first edger body 20, opposite the spray nozzle mount 13. In this way, the first surface interface 21 is positioned adjacent to the painting surface when the present invention is used to apply paint to the painting surface. The first surface interface 21 provides a non-abrasive material that is able to spread paint along the painting surface, without damaging the painting surface. In the preferred embodiment of the present invention, the first surface interface 21 is a foam material. In other embodiments of the present invention, the first surface interface 21 may comprise a plurality of brush hairs, like those of a paint brush, or any other suitable paint applicating material.

In yet further reference to FIG. 1-2, similar to the first edger 2, the second edger 3 comprises a second edger body 30 and a second surface interface 31. The second edger body 30 provides the main structure of the second edger 3, and is the portion of the second edger 3 that is mounted to the concave shell 10. Meanwhile, the second surface interface 31 is adjacently connected to the second edger body 30, wherein the second surface interface 31 is positioned along the second edger body 30, opposite the spray nozzle mount 13. In this way, the second surface interface 31 is positioned adjacent to the painting surface when the present invention is used to apply paint to the painting surface. The second surface interface 31 provides a non-abrasive material that is able to spread paint along the painting surface, without damaging the painting surface. In the preferred embodiment of the present invention, the second surface interface 31 is a foam material. In other embodiments of the present invention, the second surface interface 31 may comprise a plurality of brush hairs, like those of a paint brush, or any other suitable paint applicating material.

Figure 5:
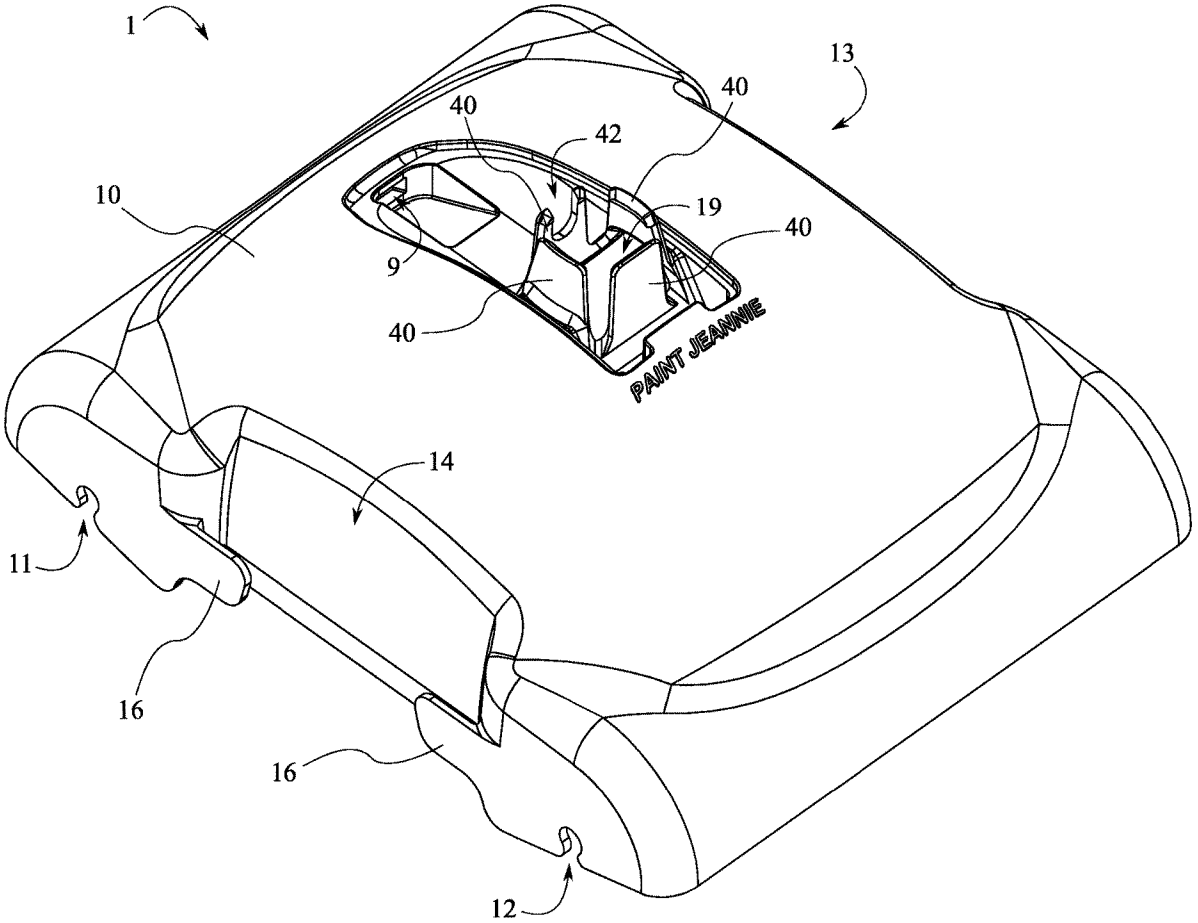
FIG. 5 is a rear right perspective view of the spray hood.
Figure 6:
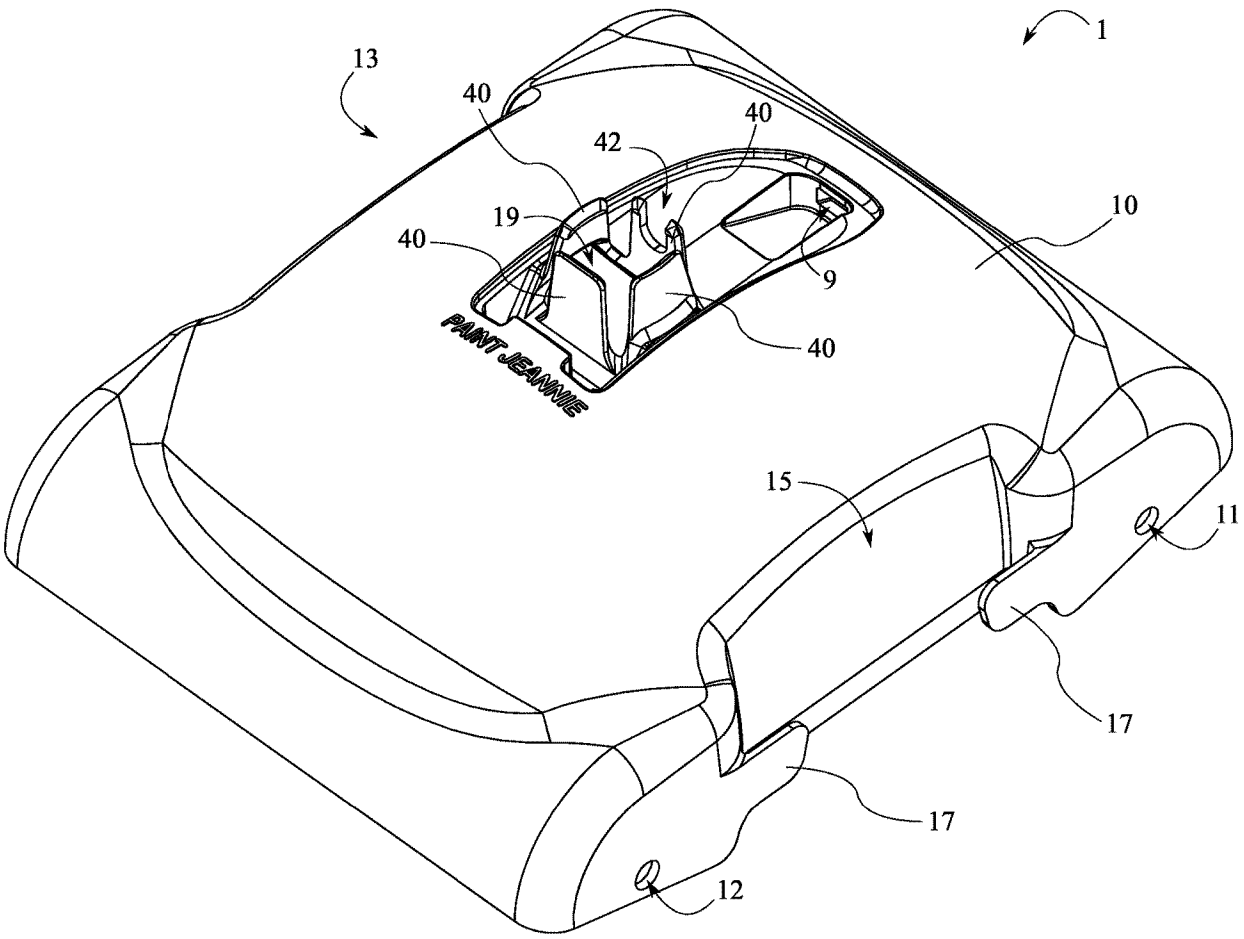
FIG. 6 is a rear left perspective view of the spray hood.

In reference to FIG. 5-6, in the preferred embodiment of the present invention, a first retention cavity 14 and a second retention cavity 15 are formed into the concave shell 10 for securing the first edger 2 and the second edger 3. The first edger 2 is positioned into the first retention cavity 14 as depicted in FIG. 1, while the second edger 3 is positioned into the second retention cavity 15 as depicted in FIG. 2. The first cavity and the second cavity allow the first edger 2 and the second edger 3, respectively, to be recessed in the concave shell 10, such that the exterior facing portion of the first surface interface 21 and the second surface interface 31 is flush with the exterior surface of the sides of the concave shell 10. This allows the present invention to fully apply paint along corners and edges of the painting surface.

Figure 7:
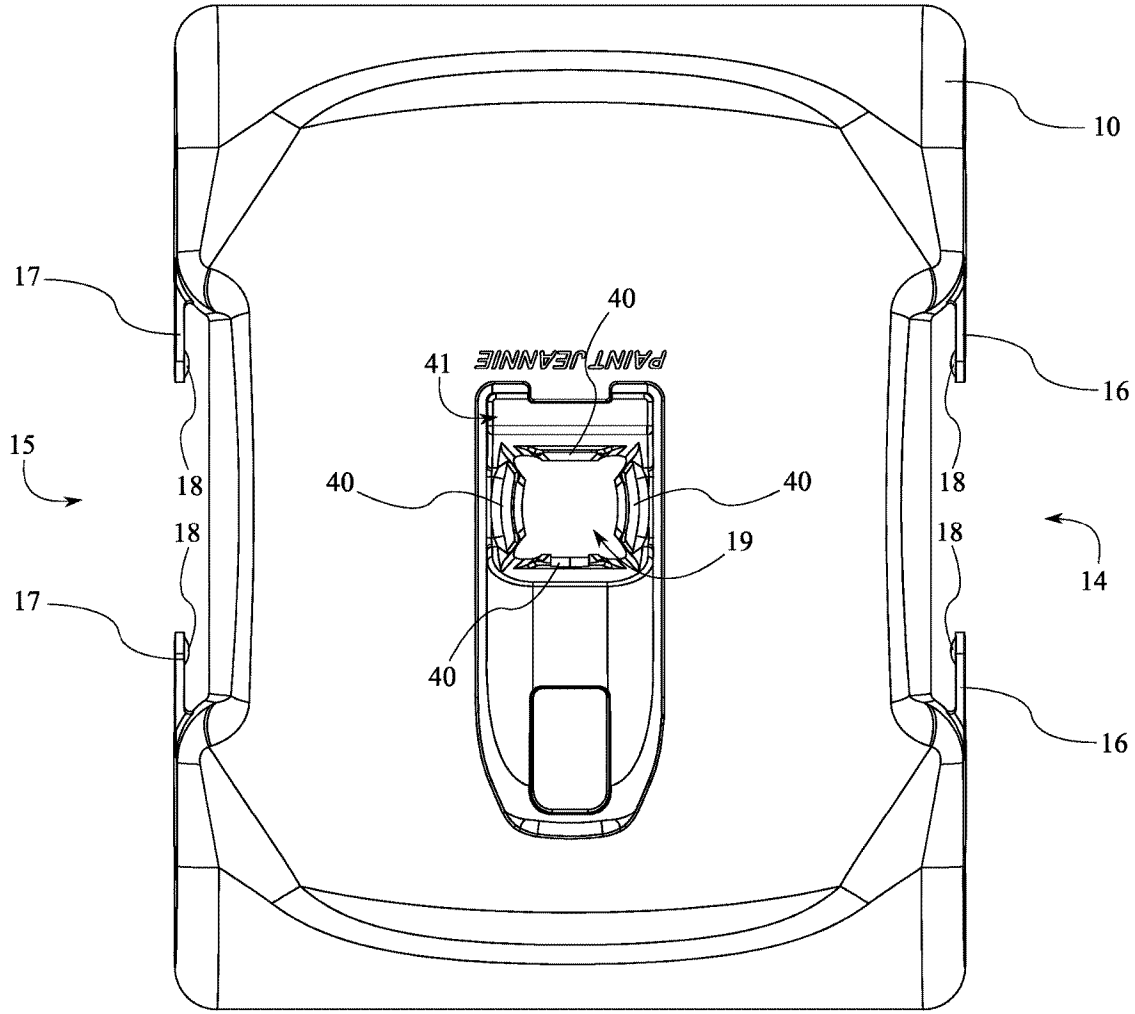
FIG. 7 is a top plan view of the spray hood.
Figure 8:
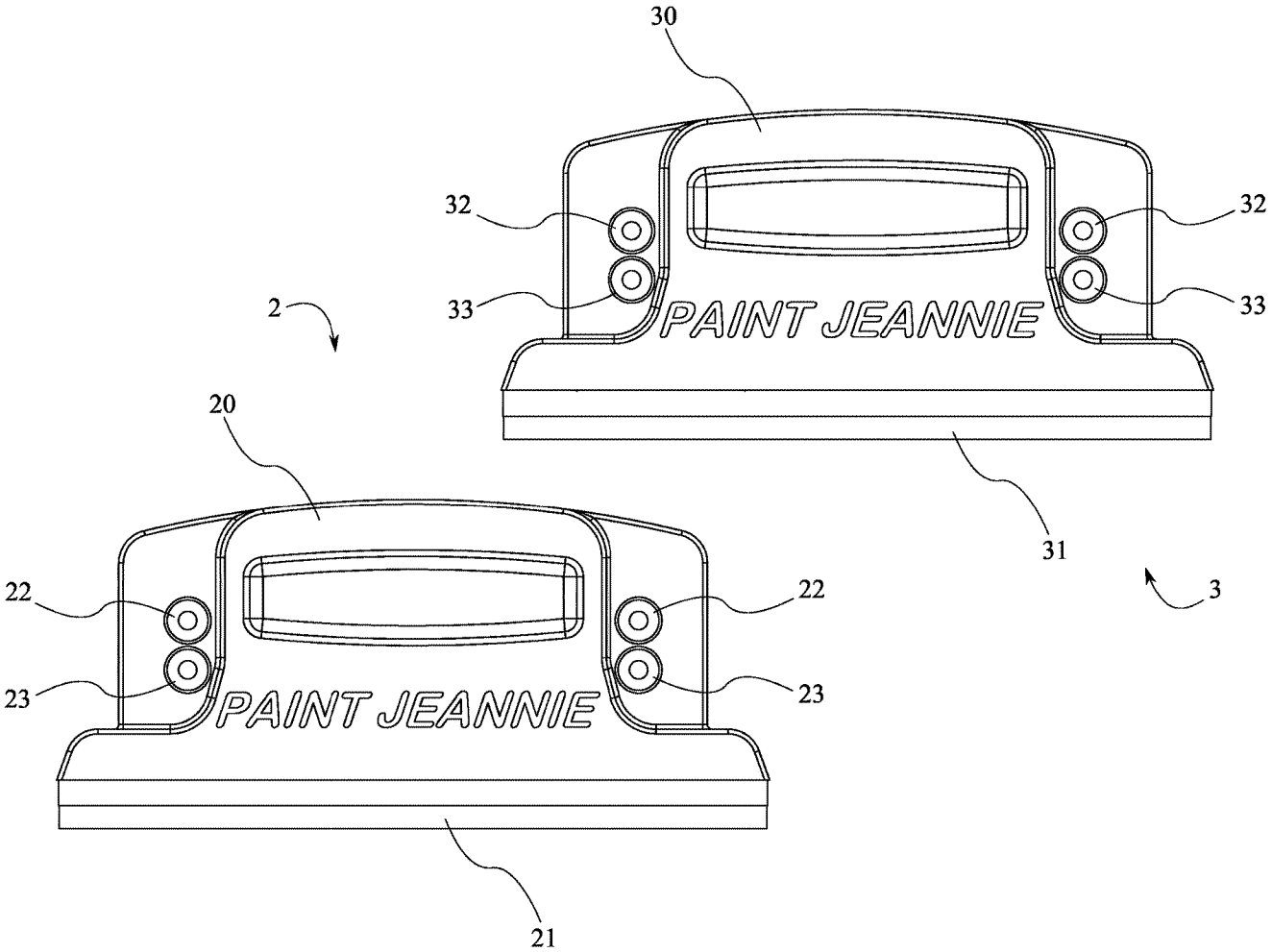
FIG. 8 is an elevational view of the first edger and the second edger.

Furthermore, in the preferred embodiment of the present invention, the concave shell 10 comprises a first pair of retention tabs 16 and a second pair of retention tabs 17. In reference to FIG. 5, the first pair of retention tabs 16 is positioned adjacent to the first retention cavity 14, wherein each of the first pair of retention tabs 16 is positioned opposite one another along the first retention cavity 14; one tab being positioned towards the front of the concave shell 10 and the other tab being positioned towards the rear of the concave shell 10. The first edger 2 is engaged with the first pair of retention tabs 16 in order to secure the first edger 2 within the first retention cavity 14, as depicted in FIG. 1. More specifically, the first edger 2 comprises a first plurality of interlocks 22, as shown in FIG. 8, while each of the first pair of retention tabs 16 comprises an interlock 18, as shown in FIG. 7; the interlock 18 of each of the first pair of retention tabs 16 being selectively engaged with a first pair of interlocks 23 from the first plurality of interlocks 22.

The interlock 18 of each of the first pair of retention tabs 16 is an extrusion; more specifically a domed-extrusion. Meanwhile, each of the first plurality of interlocks 22 is a recess; more specifically, a domed-recess. To mount the first edger 2 to the concave shell 10, the first edger 2 is inserted into the first retention cavity 14 from the bottom of the concave shell 10, wherein the first edger 2 is positioned in between the first pair of retention tabs 16 and the main body of the concave shell 10. The first plurality of interlocks 22 is arranged into two vertical rows of interlocks, along opposing sides of the first edger body 20. As the first edger 2 is pushed upwards, the interlock 18 of each of the first pair of retention tabs 16 engages with successive pairs of interlocks of the first plurality of interlocks 22. The first pair of interlocks 23 may be any pair of interlocks selected by the user from the first plurality of interlocks 22. This arrangement allows the height of the first surface interface 21 from the painting surface to be adjusted according to the user's needs, which is particularly beneficial for accommodating paint rollers of different diameters.

Similar to the first pair of retention tabs 16 and in reference to FIG. 6, the second pair of retention tabs 17 is positioned adjacent to the second retention cavity 15, wherein each of the second pair of retention tabs 17 is positioned opposite one another along the second retention cavity 15; one tab being positioned towards the front of the concave shell 10 and the other tab being positioned towards the rear of the concave shell 10. The second edger 3 is engaged with the second pair of retention tabs 17 in order to secure the second edger 3 within the second retention cavity 15, as depicted in FIG. 2. More specifically, the second edger 3 comprises a second plurality of interlocks 32, as shown in FIG. 8, while each of the second pair of retention tabs 17 comprises an interlock 18, as shown in FIG. 7; the interlock 18 of each of the second pair of retention tabs 17 being selectively engaged with a second pair of interlocks 33 from the second plurality of interlocks 32.

The interlock 18 of each of the second pair of retention tabs 17 is an extrusion; more specifically a domed-extrusion. Meanwhile, each of the second plurality of interlocks 32 is a recess; more specifically, a domed-recess. To mount the second edger 3 to the concave shell 10, the second edger 3 is inserted into the second retention cavity 15 from the bottom of the concave shell 10, wherein the second edger 3 is positioned in between the second pair of retention tabs 17 and the main body of the concave shell 10. The second plurality of interlocks 32 is arranged into two vertical rows of interlocks, along opposing sides of the second edger body 30. As the second edger 3 is pushed upwards, the interlock 18 of each of the second pair of retention tabs 17 engages with successive pairs of interlocks of the second plurality of interlocks 32. The second pair of interlocks 33 may be any pair of interlocks selected by the user from the second plurality of interlocks 32. This arrangement allows the height of the second surface interface 31 from the painting surface to be adjusted according to the user's needs, which is particularly beneficial for accommodating paint rollers of different diameters.

Together, the first paint roller 61, the second paint roller 71, the first edger 2, and the second edger 3 form a perimeter of paint applicating surfaces that are used to contain the over spray mist and spread the applied paint about the painting surface. The height adjustability of the first edger 2 and the second edger 3 allows for the accommodation of different diameter paint rollers to be used with the present invention. For example, if the first paint roller 61 and the second paint roller 71 have a smaller diameter, then the first edger 2 and the second edger 3 can be raised, such that the first edger 2 and the second edger 3 do not impede the first paint roller 61 and the second paint roller 71 from contacting the painting surface. As another example, if the first paint roller 61 and the second paint roller 71 have a larger diameter, then the first edger 2 and the second edger 3 can be lowered, such that the first edger 2 and the second edger 3 adequately enclose the sides of the concave shell 10.

In reference to FIG. 5-6, the spray nozzle mount 13 provides a means for securing the paint sprayer to the concave shell 10, while allowing the paint sprayer to be readily detached. The spray nozzle mount 13 is integrated into the top of the concave shell 10, wherein the spray nozzle mount 13 is positioned in between the first edger 2 and the second edger 3, and positioned in between the first pair of roller retention slots 11 and the second pair of roller retention slots 12. The central positioning of the spray nozzle mount 13 ensures that the paint spray is evenly dispersed within the concave shell 10 (and not disproportionately directed at one portion of the interior).

In further reference to FIG. 5-6, the spray nozzle mount 13 comprises a plurality of flex tabs 40 and a nozzle guard slot 41. The plurality of flex tabs 40 is radially positioned around the nozzle aperture 19, while the nozzle guard slot 41 is positioned adjacent to the plurality of flex tabs 40 opposite the nozzle aperture 19. A spray tip notch 42 is formed into one of the plurality of flex tabs 40 in order to accommodate the spray tip of the paint sprayer. The spray tip notch 42 is distally positioned from the concave shell 10, such that the spray tip notch 42 is oriented at the top of the plurality of flex tabs 40. To secure the present invention to the paint sprayer, the spray guard of the paint sprayer is first aligned with the nozzle guard slot 41. The spray guard is then pressed and snapped into the spray nozzle mount 13, wherein the distal end of the spray guard is positioned into the nozzle guard slot 41, the proximal end of the nozzle guard is positioned in between each of the plurality of flex tabs 40, and the spray tip is slotted into the spray tip notch 42.

In the preferred embodiment of the present invention, the plurality of flex tabs 40 is specifically four flex tabs; the four flex tabs being equidistantly positioned around the nozzle aperture 19. The four flex tabs are arranged in a square formation, having a front tab, a rear tab, and two side tabs. In this way, each side of the proximal end of the spray guard is secured by the spray nozzle mount 13. The spray tip notch 42 is formed into the front tab.

In reference to FIG. 1-2, the spray nozzle retainer 5 is used in conjunction with the spray nozzle mount 13 to secure the paint sprayer to the concave shell 10. The spray nozzle retainer 5 is adjacently attached to the concave shell 10, wherein the spray nozzle retainer 5 is positioned about the spray nozzle mount 13. The spray nozzle retainer 5 encompasses the plurality of flex tabs 40, such that pressure is applied inwards on the plurality of flex tabs 40 in order to hold the spray guard in place. Furthermore, the spray nozzle retainer 5 rests against the legs of the spray guard and sits above the distal end of the spray guard that is positioned into the nozzle guard slot 41. In this way, the spray nozzle retainer 5 obstructs the spray guard from being pulled out of the spray nozzle mount 13.

In the preferred embodiment of the present invention, the spray nozzle retainer 5 comprises a main panel 51, a lock tab 50, a first locking extrusion 52, and a second locking extrusion 53. The first locking extrusion 52 and the second locking are terminally connected to the main panel 51, while the lock tab 50 is terminally integrated into the main panel 51, opposite the first locking extrusion 52 and the second locking extrusion 53. The first locking extrusion 52 and the second locking extrusion 53 are positioned opposite each other across the main panel 51, wherein the first locking extrusion 52 and the second locking extrusion 53 are positioned on opposite sides of the plurality of flex tabs 40 when the spray nozzle retainer 5 is attached to the concave shell 10. The lock tab 50 may be a snap lock, a spring-loaded button, a slide lock, or any other suitable locking mechanism that is able to selectively engage with the concave shell 10 in order to attach and release the spray nozzle retainer 5 to and from the concave shell 10.

Once the spray guard has been secured within the spray nozzle mount 13, the spray nozzle retainer 5 is slid and snapped into place. The first locking extrusion 52 is positioned into a first cavity of the concave shell 10, while the second locking extrusion 53 is positioned into a second cavity of the concave shell 10; the first cavity and the second cavity being positioned adjacent to the spray nozzle mount 13. With the first locking extrusion 52 and the second locking extrusion 53 in position, the main panel 51 is then pressed downwards, wherein the main panel 51 is positioned around the plurality of flex tabs 40 and the spray guard. The lock tab 50 is then engaged with a lock cavity 9 of the concave shell 10, wherein the main panel 51 is secured in place. To remove the spray nozzle retainer 5, the lock tab 50 is disengaged from the lock cavity 9, allowing the main panel 51 to be lifted, and the first locking extrusion 52 and the second locking extrusion 53 to be removed from the first cavity and the second cavity respectively.

Figure 9:
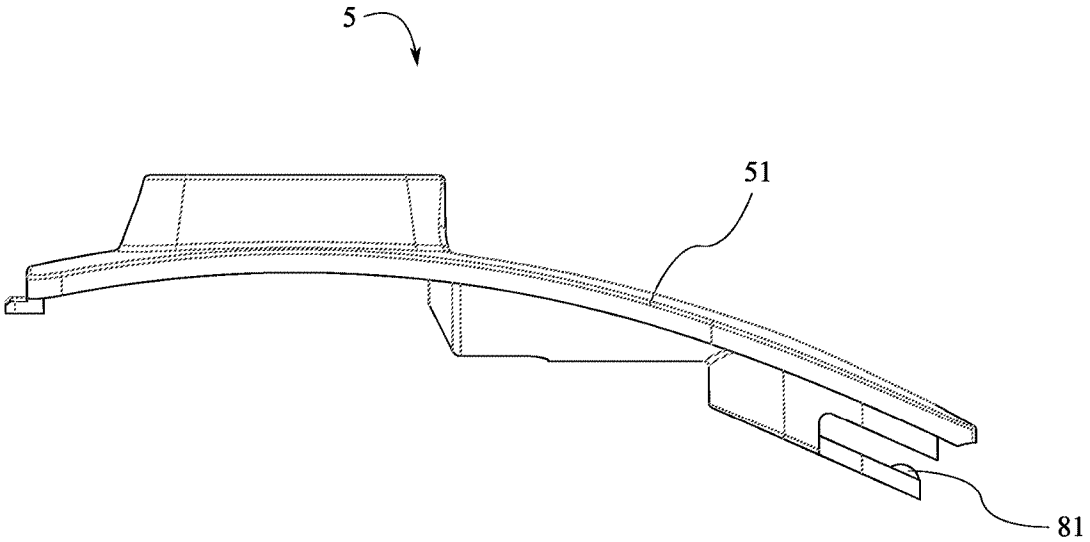
FIG. 9 is a left side elevational view of the spray nozzle retainer, wherein the lock tab is removed to show the first interlocking fixture.
Figure 10:
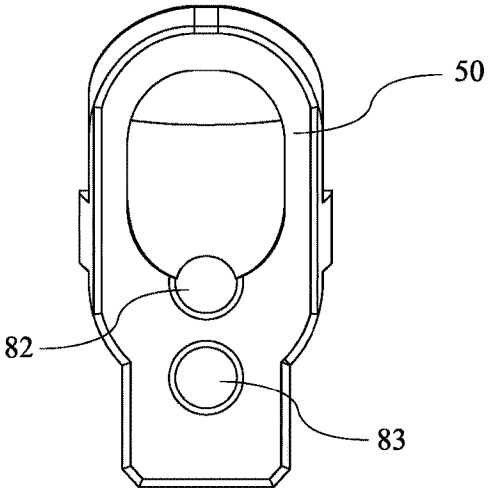
FIG. 10 is a bottom plan view of the lock tab removed from the main panel to show the second interlocking fixture and the third interlocking fixture.
Figure 11:
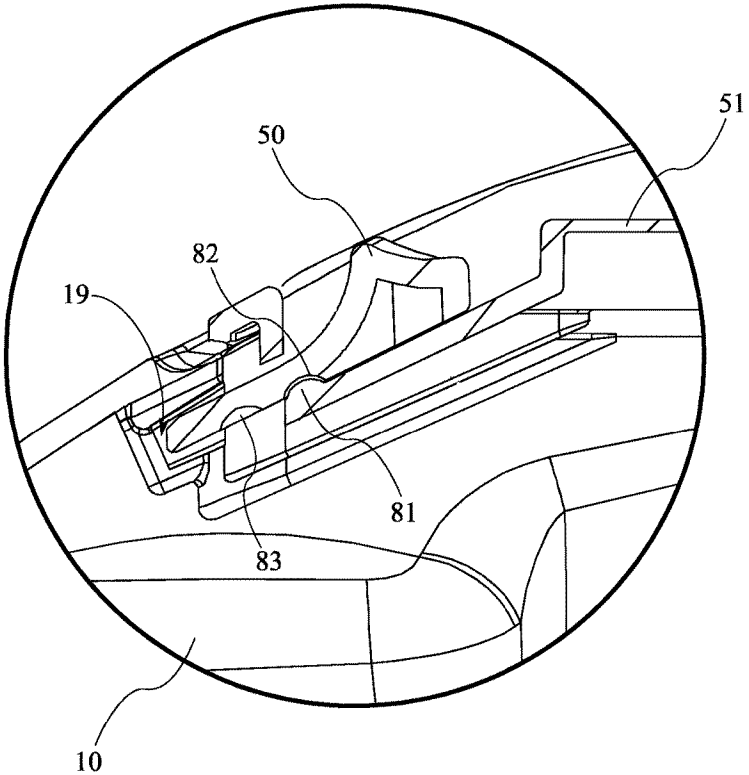
FIG. 11 is a magnified sectional view showing the lock tab being positioned into the lock cavity, wherein the first interlocking fixture is engaged with the second interlocking fixture.
Figure 12:
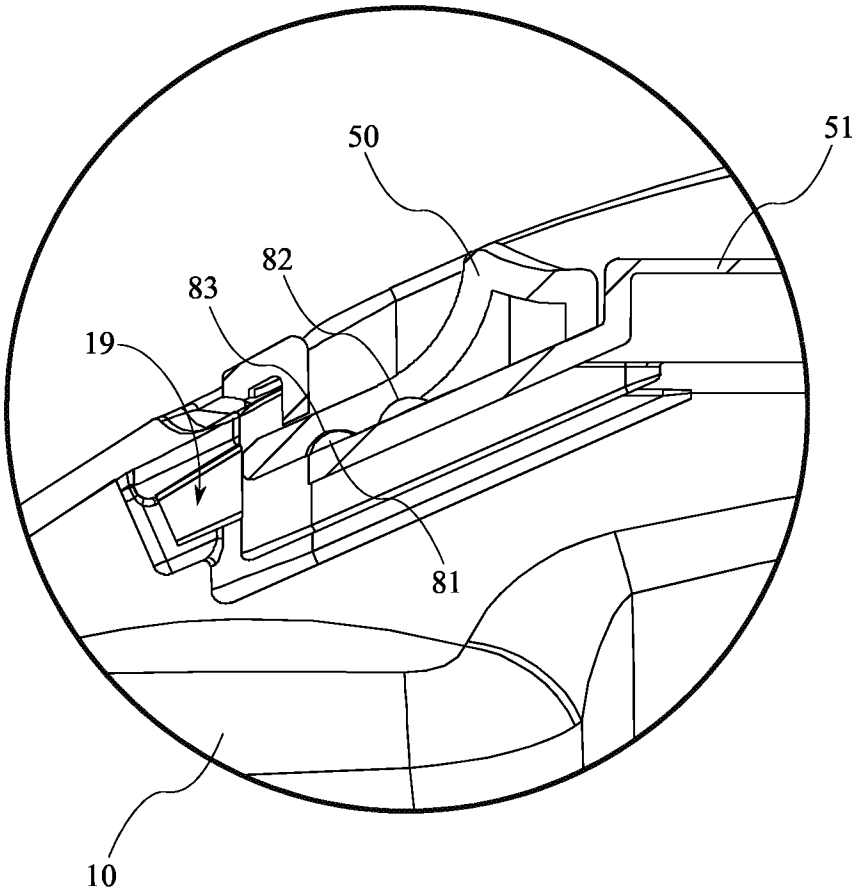
FIG. 12 is a magnified sectional view showing the lock tab being removed from the lock cavity, wherein the first interlocking fixture is engaged with the third interlocking fixture.

In the preferred embodiment of the present invention, the main panel 51 includes a first interlocking fixture 81, as shown in FIG. 9, while the lock tab 50 comprises a second interlocking fixture 82 and a third interlocking fixture 83, as shown in FIG. 10. The first interlocking fixture 81 is a domed-extrusion, while each of the second interlocking fixture 82 and the third interlocking fixture 83 is a domed-recess. The lock tab 50 is slidably connected to the main panel 51, wherein the first interlocking fixture 81 is selectively engaged with either the second interlocking fixture 82 or the third interlocking fixture 83. When the lock tab 50 is slid in a first direction, the lock tab 50 is positioned into the lock cavity 9 and the first interlocking fixture 81 is engaged with the second interlocking fixture 82, as shown in FIG. 11. The engagement of the first interlocking fixture 81 with the second interlocking fixture 82 prevents the lock tab 50 from being pulled from the lock cavity 9 without sufficient force being applied to the lock tab 50 in a second direction, opposite to the first direction. When the lock tab 50 is slid in the second direction, out of the lock position, the second interlocking fixture 82 is disengaged from the first interlocking fixture 81, allowing the lock tab 50 to be pulled out of the lock cavity 9. By continuing to apply force in the second direction, the third interlocking fixture 83 is engaged with the first interlocking fixture 81, as shown in FIG. 12, wherein the lock tab 50 is held in an unlocked position.

A retainer removal slot is formed into the concave shell 10 to assist in the removal of the spray nozzle retainer 5. The retainer removal slot is positioned towards the front of the concave shell 10, such that the retainer removal slot is positioned adjacent to the lock tab 50 when the spray nozzle retainer 5 is attached to the concave shell 10. The retainer removal slot traverses along the terminal edge of the main panel 51, wherein the retainer removal slot allows the user to reach underneath the main panel 51 in order to gain leverage to lift the spray nozzle retainer 5 up and away from the concave shell 10.

A spray pole can also be attached to the paint sprayer, when the present invention is attached to the paint sprayer. The spray pole allows the user to navigate the present invention about ceilings, high walls, or other hard to reach surfaces. The first paint roller 61 and the second paint roller 71 allow the spray hood to be easily navigated the painting surface, while the spray pole allows the present invention to swivel up, down, and sideways. With or without the spray pole, as the paint is sprayed on the painting surface, the user can roll the present invention up, down, and/or sideways without getting any over spray, paint drips, or splatters anywhere outside the unit as the spray hood 1, the first edger 2, the second edger 3, the first paint roller 61, and the second paint roller 71 completely seal the paint inside.

Although the invention has been explained in relation to its preferred embodiment, it is to be understood that many other possible modifications and variations can be made without departing from the spirit and scope of the invention as hereinafter claimed.

What is claimed is:

1. A paint sprayer attachment comprises:

a spray hood having comprising a concave shell having a top, a bottom, a front, a rear, and lateral sides in between the front and the rear; said spray hood configured to face a surface to be painted such that said bottom of the concave shell is disposed directly adjacent the surface to be painted;

a first pair of roller retention slots, a second pair of roller retention slots, and a spray nozzle mount;

a first edger and a second edger being laterally mounted to the concave shell; the first edger and the second edger being positioned opposite each other on opposite sides of the concave shell; the first pair of roller retention slots and the second pair of roller retention slots being integrated into the concave shell;

the first edger comprising a first edger body and a first surface interface; the first edger body being mounted to the concave shell; and the first surface interface being positioned along the first edger body, said first surface interface extending from the first edger body to the bottom of the concave shell at a surface of the concave shell opposite the spray nozzle mount which is positioned at the top of the concave shell; the second edger comprising a second edger body and a second surface interface; the second edger body being mounted to the concave shell; and the second surface interface being positioned along the second edger body, said first surface interface extending from the first edger body to the bottom of the concave shell, at surface of the concave shell opposite the spray nozzle mount which is positioned at the top of the concave shell; said first surface interface and said second surface interface include a non-abrasive material that is able to spread paint along the surface to be painted, without damaging the surface to be painted, the first edger and second edger each enclose the bottom of a side of the spray hood; the first surface interface is positioned into a first retention cavity such that an exterior facing portion of the first surface interface is flush with an exterior surface of lateral side of the concave shell; the second surface interface is positioned into a second retention cavity such that an exterior facing portion of the second surface interface is flush with an exterior surface of lateral side of the concave shell;

the first pair of roller retention slots and the second pair of roller retention slots being positioned opposite each other along the concave shell; said first pair of roller retention slots being positioned towards the front of the concave shell and configured to receive a first roller, said second pair of roller retention slots being positioned towards the rear of the concave shell and configured to receive a second roller, the first edger and the second edger being positioned in between the first pair of roller retention slots which are located towards the front of the concave shell and the second pair of roller retention slots which are located towards the rear of the concave shell;

the spray nozzle mount being integrated into the concave shell about a nozzle aperture; said nozzle aperture allows a spray tip of a paint sprayer to be directed into an interior of the concave shell; the first pair of roller retention slots and the second pair of roller retention slots being distally positioned from the spray nozzle mount; the spray nozzle mount being positioned on the top of the concave shell in between the first edger and the second edger; and the spray nozzle mount being positioned in between the first pair of roller retention slots and the second pair of roller retention slots, and;

the spray hood having structure configured to receive the first roller and the second roller such that the first roller, the second roller, the first edger, and the second edger form a perimeter of paint application surfaces configured to contain a spray mist and spread applied paint about the surface to be painted.

2. The paint sprayer attachment as claimed in claim 1 comprises: the concave shell further comprising a first pair of retention tabs; the first pair of retention tabs being positioned adjacent to the first retention cavity; each of the first pair of retention tabs being positioned opposite one another, along the first retention cavity; and the first edger being engaged with the first pair of retention tabs.

3. The paint sprayer attachment as claimed in claim 2 comprises:

the first edger comprising a first plurality of interlocks;

each of the first pair of retention tabs comprising an interlock; and the interlock of each of the first pair of retention tabs being selectively engaged with a first pair of interlocks from the first plurality of interlocks.

4. The paint sprayer attachment as claimed in claim 1 comprises: the concave shell further comprising a second pair of retention tabs; the second pair of retention tabs being positioned adjacent to the second retention cavity; each of the second pair of retention tabs being positioned opposite one another, along the second retention cavity; and the second edger being engaged with the second pair of retention tabs.

5. The paint sprayer attachment as claimed in claim 4 comprises:

the second edger comprising a second plurality of interlocks;

each of the second pair of retention tabs comprising an interlock; and the interlock of each of the second pair of retention tabs being selectively engaged with a second pair of interlocks from the second plurality of interlocks.

6. The paint sprayer attachment as claimed in claim 1, wherein the first surface interface is a foam material.

7. The paint sprayer attachment as claimed in claim 1, wherein the second surface interface is a foam material.

8. The paint sprayer attachment as claimed in claim 1 comprises:

the spray nozzle mount comprising a plurality of flex tabs and a nozzle guard slot;

the plurality of flex tabs being radially positioned around the nozzle aperture; and the nozzle guard slot traversing around the plurality of flex tabs.

9. The paint sprayer attachment as claimed in claim 8 comprises:

a spray tip notch;

the spray tip notch being formed into one of the plurality of flex tabs; and the spray tip notch being distally positioned from the concave shell.

10. The paint sprayer attachment as claimed in claim 8, wherein the plurality of flex tabs is specifically four flex tabs equidistantly positioned around the nozzle aperture.

11. The paint sprayer attachment as claimed in claim 1 comprises:

a spray nozzle retainer;

the spray nozzle retainer being adjacently attached to the concave shell; and the spray nozzle retainer being positioned about the spray nozzle mount.

12. The paint sprayer attachment as claimed in claim 11 comprises:

the spray nozzle retainer comprising a lock tab; and the lock tab traversing into a lock cavity of the concave shell.

13. The paint sprayer attachment as claimed in claim 1 comprises:

a first pair of roller mounts; and each of the first pair of roller mounts being mounted into a corresponding retention slot from the first pair of roller retention slots.

14. The paint sprayer attachment as claimed in claim 13 comprises: the first roller; and each of the first pair of roller mounts being terminally attached to the first roller.

15. The paint sprayer attachment as claimed in claim 1 comprises:

a second pair of roller mounts; and each of the second pair of roller mounts being mounted into a corresponding retention slot from the second pair of roller retention slots.

16. The paint sprayer attachment as claimed in claim 15 comprises: the second roller; and each of the second pair of roller mounts being terminally attached to the second roller.

* * * * *